US007945982B2

(12) United States Patent
Hsieh

(10) Patent No.: US 7,945,982 B2
(45) Date of Patent: May 24, 2011

(54) MOP STRUCTURE

(75) Inventor: Ming-Ti Hsieh, Taipei (TW)

(73) Assignee: Perfect & Glory Enterprise Co., Ltd., Taipei (TW)

( * ) Notice: Subject to any disclaimer, the term of this patent is extended or adjusted under 35 U.S.C. 154(b) by 622 days.

(21) Appl. No.: 12/126,200

(22) Filed: May 23, 2008

(65) Prior Publication Data

US 2009/0288261 A1 Nov. 26, 2009

(51) Int. Cl.
*A47L 13/144* (2006.01)

(52) U.S. Cl. ..... 15/119.2

(58) Field of Classification Search ..... 15/116.1, 15/116.2, 119.1, 119.2
See application file for complete search history.

(56) References Cited

U.S. PATENT DOCUMENTS 2,251,384 A * 8/1941 Thomas ..... 15/119.1
3,008,163 A * 11/1961 Bommer ..... 15/119.2
6,119,297 A * 9/2000 Ohm et al. ..... 15/119.2

* cited by examiner

*Primary Examiner* — Randall Chin
(74) *Attorney, Agent, or Firm* — WPAT, P.C.; Anthony King

(57) ABSTRACT

A mop structure includes an adjusting sleeve sheathed to a mop tube, and the mop tube slidably connected to a slide bushing includes a slide bushing thread secured with a corresponding adjusting sleeve thread. A pull handle is pivotally connected to the slide bushing and turned up and down the slide bushing. A water squeeze head at a lower end of the mop tube includes at least two water squeeze rollers on opposite sides of the water squeeze head to define a gap. An upper edge of each link arm is pivotally connected to the pull handle, and a lower edge includes a hooking bracket. A cleaning element includes two hooking holes for receiving a hooking bracket of each link arm. The cleaning element is driven by the pull handle and the link arm, passed through the gap, and squeezed by the water squeeze rollers.

8 Claims, 8 Drawing Sheets

MOP STRUCTURE

FIELD OF THE INVENTION

The present invention relates to a mop structure, and more particularly to a mop structure with a convenient mounting or dismounting effect and a good water squeeze effect to improve the convenience of using a mop.

BACKGROUND OF THE INVENTION

Referring to FIGS. 1 and 2 for an exploded view and a cross-sectional view of a traditional mop structure respectively, the traditional mop structure 9 includes a mop tube 91, a pull handle 92, a water squeeze head 93, two link arms 94 and a sponge 95.

The mop tube 91 is installed to the water squeeze head 93, and the water squeeze head 93 includes a plurality of water squeeze rollers 931 disposed on opposite sides of the water squeeze head 93. The pull handle 92 is pivotally coupled to the mop tube 91 and can be turned up and down with respect to the mop tube 91. Each link arm 94 is passed through the water squeeze head 93, and an end of each link arm 94 is pivotally coupled to the pull handle 92 and another end of each link arm 94 is secured to the sponge 95 by screws 941.

During the use of the mop, the sponge 95 is dipped into water, and then the pull handle 92 is pulled to lift the mop tube 91, such that the pull handle 92 drives each link arm 94 to move upward, and each link arm 94 drives the sponge 95 to move upward as well. By then, the sponge 95 is squeezed by the water squeeze rollers 931 to achieve the effect of removing water from the sponge 95.

However, each link arm 94 is secured to the sponge 95 by the screws 941, so that a tool (such as a screwdriver) is required for replacing the sponge 95. A more complicated procedure is involved, and thus the traditional mop structure causes tremendous troubles to housewives and those who do lots of housework.

In addition, the sponge 95 will become aged and loosened after being used for a while as shown in FIG. 2. In other words, the sponge 95 will be stretched or drooped to produce a loosened section 951 as shown in FIG. 2. When the pull handle 92 is pulled to drive the sponge 95 to move upward and pass through the water squeeze rollers 931, the effect of removing water by squeezing the sponge 95 through the water squeeze rollers 931 becomes poor. On the other hand, the sponge 95 cannot be attached closely to the water squeeze rollers 931, so that when the mop is used for mopping a floor, the sponge 95 will be shaken or even broken. The traditional mop structure definitely requires improvements.

It is an important subject for manufacturers to develop a mop structure that provides a convenient mount or dismount and improves the water squeeze effect and the convenience of use.

SUMMARY OF THE INVENTION

In view of the foregoing shortcomings of the prior art, the inventor of the present invention based on years of experience in the related field to conduct extensive researches and experiments, and finally developed a mop structure in accordance with the present invention to overcome the shortcomings of the prior art.

Therefore, it is a primary objective of the present invention to provide a mop structure that provides easy mount and dismount and improves the water squeeze effect and the convenience of use.

To achieve the foregoing objective of the invention, the mop structure comprises a mop tube, an adjusting sleeve, a slide bushing, a pull handle, a water squeeze head, two link arms and a cleaning element.

The mop tube includes a fixing portion disposed at an appropriate position. The adjusting sleeve is sheathed to the mop tube and coupled adjacently to the fixing portion and can be turned with respect to the mop tube. The adjusting sleeve includes an adjusting sleeve thread.

Further, the slide bushing is slidably installed at the mop tube, and the slide bushing includes a slide bushing thread secured to an adjusting sleeve thread of the adjusting sleeve correspondingly. The pull handle is pivotally coupled to the slide bushing and can be turned up and down with respect to the slide bushing. The water squeeze head is installed at a lower end of the mop tube, and the water squeeze head includes at least two water squeeze rollers, and a gap is defined between two opposite sides of the water squeeze rollers.

Further, each link arm includes an upper edge and a lower edge, and the upper edge is pivotally coupled to the pull handle can be turned with respect to the pull handle, and the lower edge includes a hooking bracket. The cleaning element includes two hooking holes, and each hooking hole is provided for connecting a hooking bracket of each link arm, and the cleaning element is driven by the pull handle and each link arm, passed through the gap and squeezed by each water squeeze roller.

Therefore, the structural design of hooking the hooking bracket into the hooking hole provides an easy way of mounting and dismounting the cleaning element without requiring an additional tool, and thus the application is very convenient. Further, the structural design of screwing the adjusting sleeve thread of the adjusting sleeve and the slide bushing thread of the slide bushing allows the slide bushing to move up and down the mop tube for adjusting the height of the slide bushing with respect to the mop tube in order to adjust the relative distance between the cleaning element and the water squeeze roller (or adjust the connection and separation of the cleaning element and the water squeeze rollers) and avoid the poor water squeeze effect, shaking or breaking issues caused by the ageing and loosening of the traditional cleaning element.

DESCRIPTION OF THE PREFERRED EMBODIMENT

The above and other objects, features and advantages of the present invention will become apparent from the following detailed description taken with the accompanying drawing.

Figure 1:
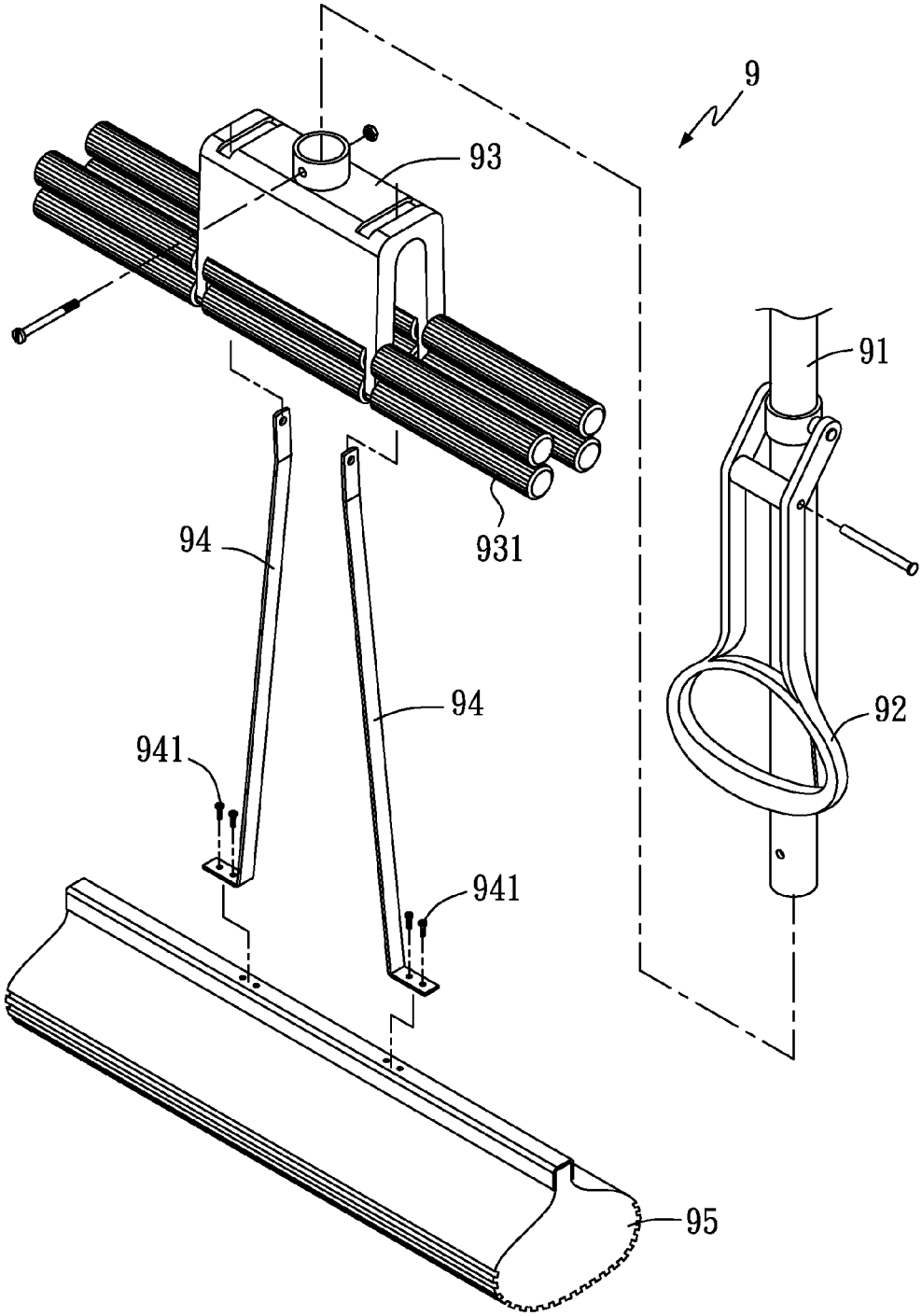
(PRIOR ART) Fig. 1
FIG. 1 is an exploded view of a traditional mop structure.
Figure 2:
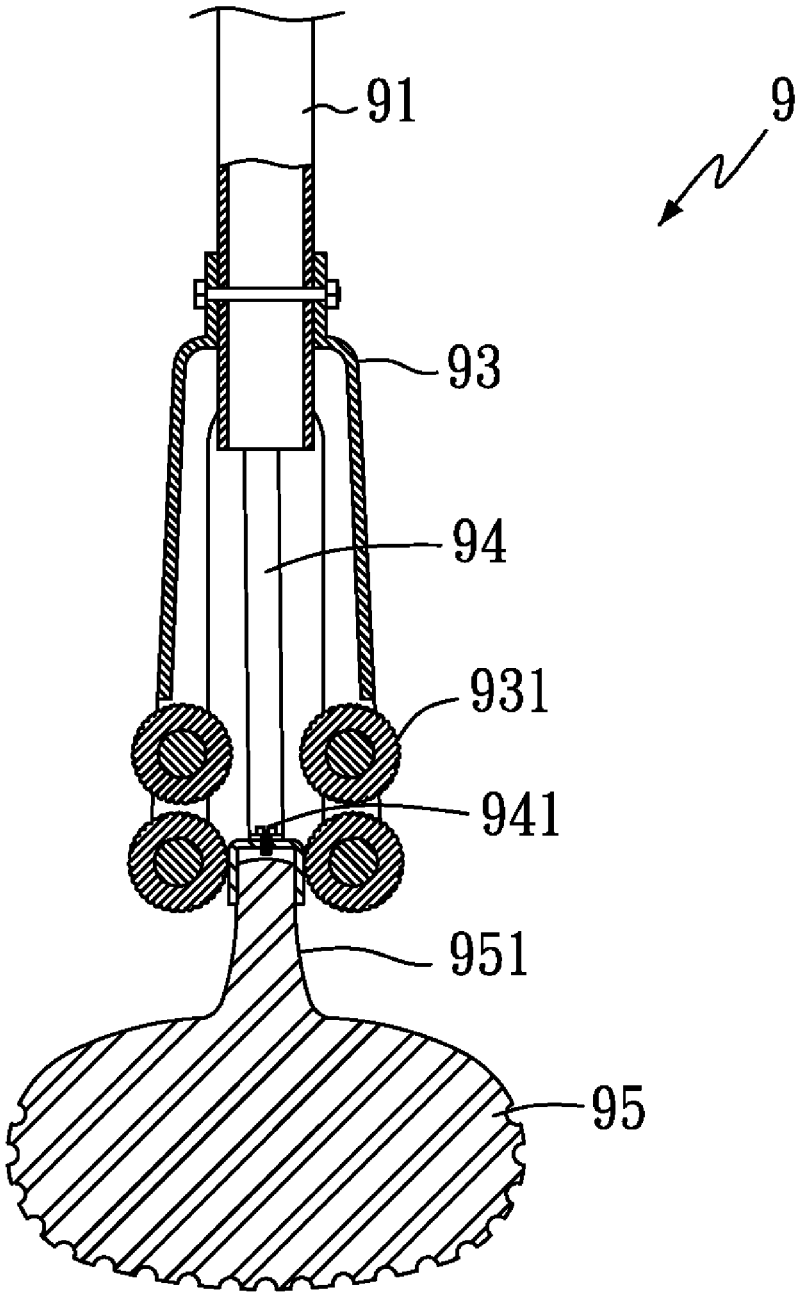
(PRIOR ART) Fig. 2
FIG. 2 is a cross-sectional view of a traditional mop structure.
Figure 3:
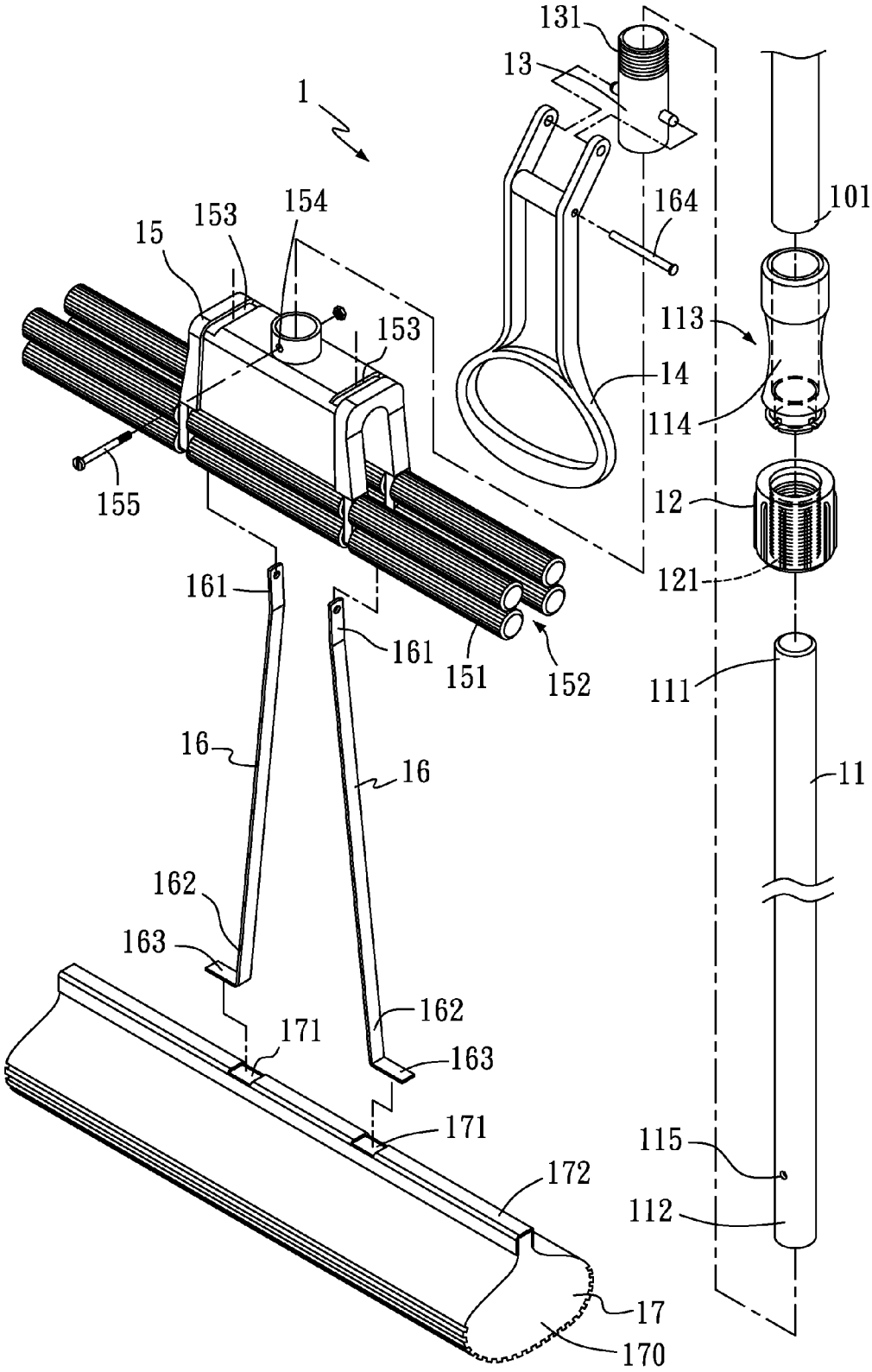
FIG. 3 is an exploded view of a mop structure in accordance with a first preferred embodiment of the present invention.
Figure 4:
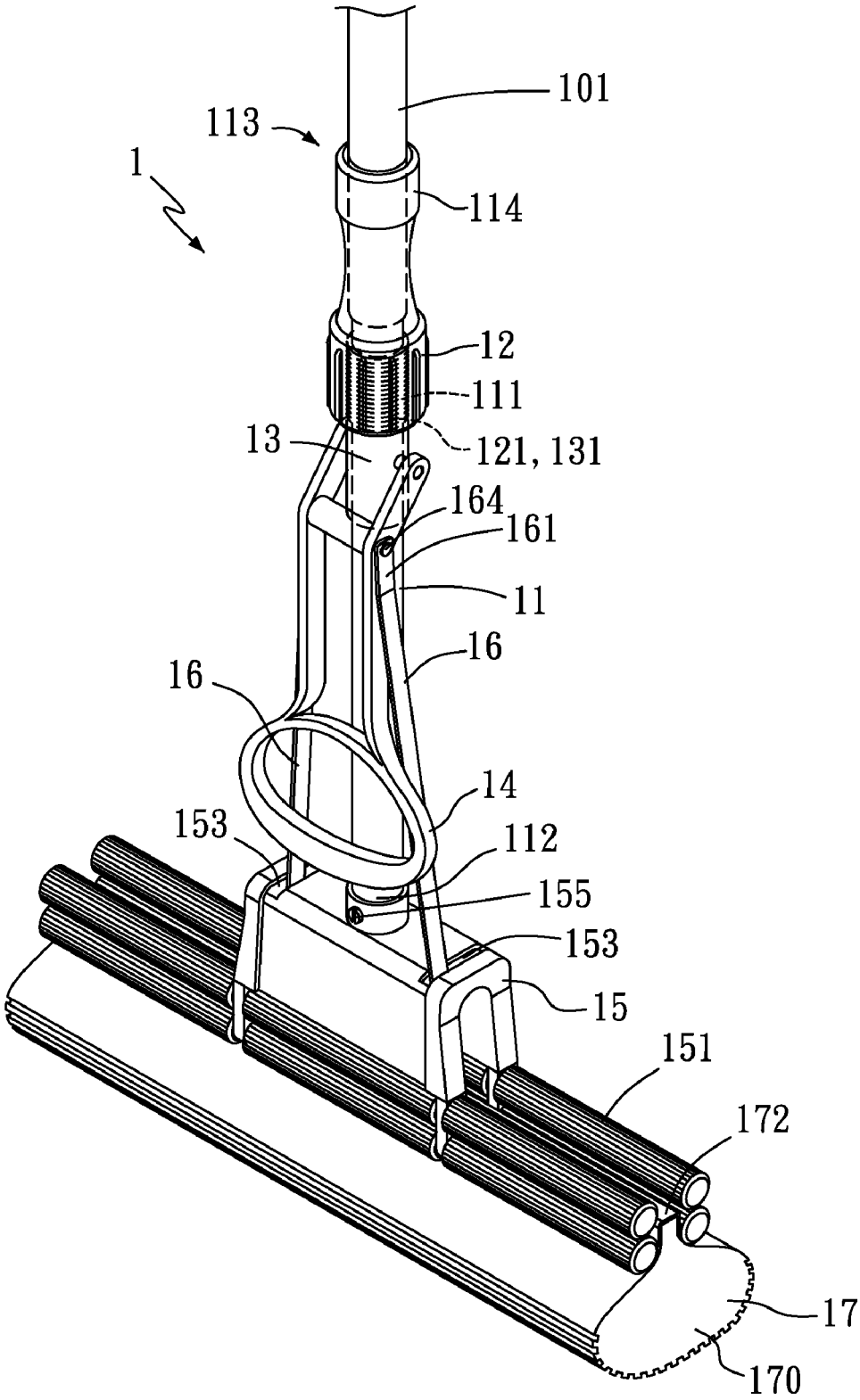
FIG. 4 is a perspective view of a mop structure in accordance with a first preferred embodiment of the present invention.
Figure 5:
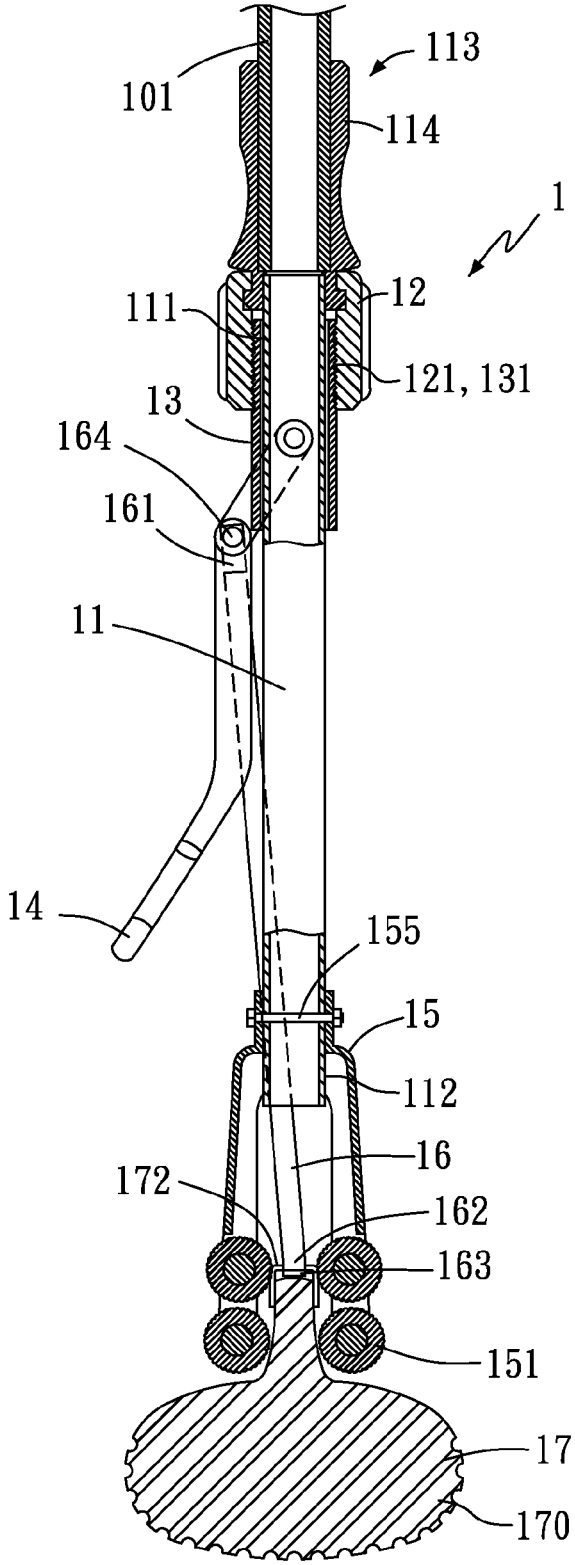
FIG. 5 is a cross-sectional view of a mop structure a mop structure in accordance with a first preferred embodiment of the present invention.
Figure 6:
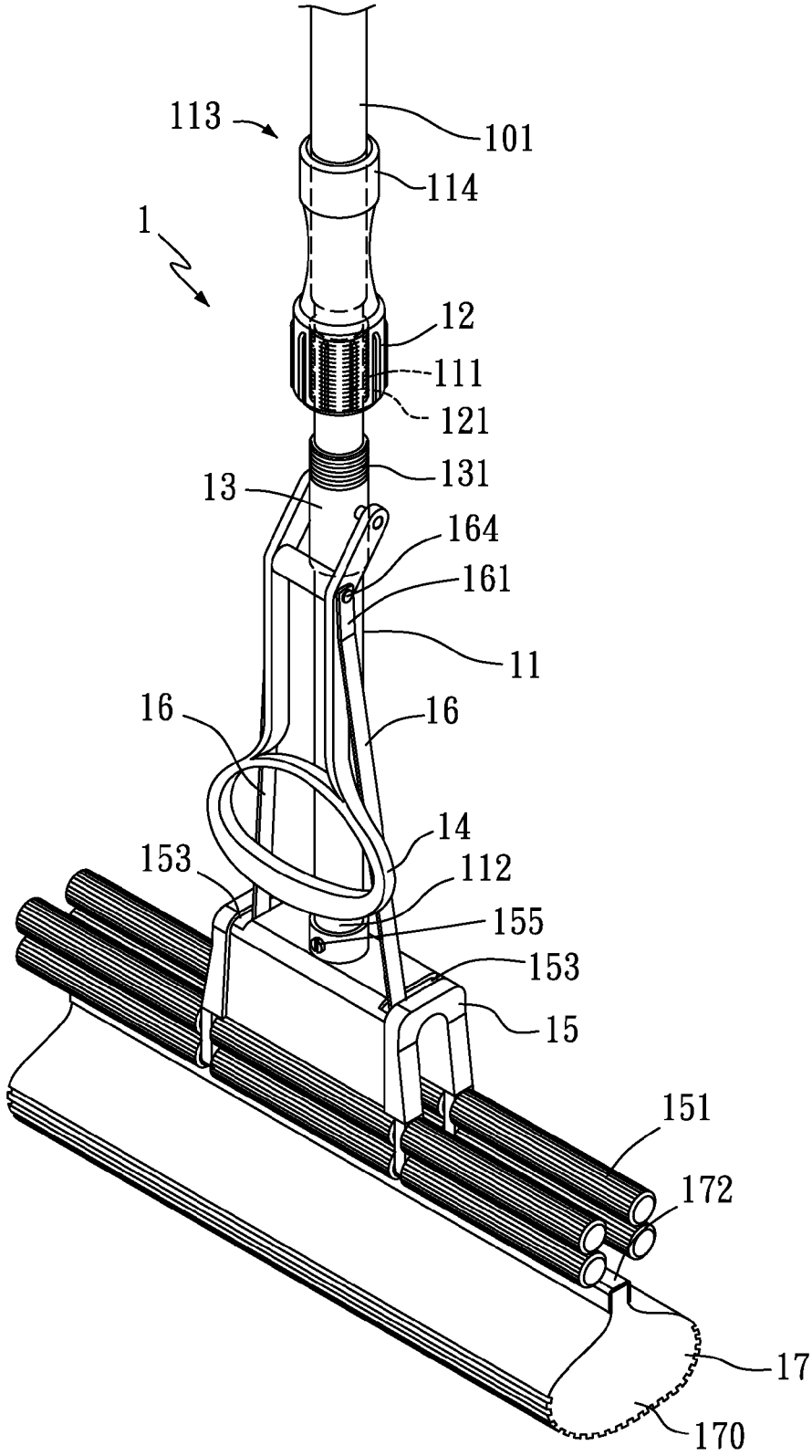
FIG. 6 is another perspective view of a mop structure a mop structure in accordance with a first preferred embodiment of the present invention.

Referring to FIGS. 3 to 5 for an exploded view, a perspective view and a cross-sectional view of a mop structure in accordance with a first preferred embodiment of the invention respectively, the mop structure 1 comprises a mop tube 11, an adjusting sleeve 12, a slide bushing 13, a pull handle 14, a water squeeze head 15, two link arms 16 and a cleaning element 17.

The mop tube 11 includes a fixing portion 113 disposed at an appropriate position 111 (which refers to an upper end of the mop tube 11 in this embodiment), and the fixing portion 113 includes a fixing sleeve 114 tightly sheathed to the appropriate position 111 of the mop tube 11.

To facilitate the use and storage of the mop structure 1, the mop tube 11 comes with a short length and includes an upper mop tube 101 installed at the fixing sleeve 114. In other words, the mop tube 11 and the upper mop tube 101 are engaged with each other by the fixing sleeve 114. In this embodiment, the upper mop tube 101 is similarly and tightly fixed with the fixing sleeve 114, or a plurality of circular protruding bars are disposed at protruding bars of the upper mop tube 101 or on the mop tube 11, and a plurality of circular grooves are designed in the fixing sleeve 114, such that when the upper mop tube 101 or the mop tube 11 is inserted into the fixing sleeve 114, the circular protruding bars are embedded into the circular grooves. Of course, the invention is not limited to the aforementioned embedment or connection only, but any mechanical structural design with the same effect can be used as well. The upper mop tube 101 and the mop tube 11 may be a design of two sections or a design of three or more sections, depending on actual needs.

In the figures, the adjusting sleeve 12 is sheathed into the mop tube 11 and coupled adjacently to the fixing portion 113, and the adjusting sleeve 12 is turned with respect with the mop tube 11. In this embodiment, the adjusting sleeve 12 includes an adjusting sleeve thread 121, and the adjusting sleeve thread 121 of the adjusting sleeve 12 is an internal thread.

In the figures, the slide bushing 13 is slidably disposed at the mop tube 11, and the slide bushing 13 includes a slide bushing thread 131 which is an external thread in this embodiment and secured with the corresponding adjusting sleeve thread 121 of the adjusting sleeve 12.

Further, the pull handle 14 is pivotally coupled to the slide bushing 13 and can be turned up and down with respect to the slide bushing 13. The water squeeze head 15 is installed at a lower end 112 of the mop tube 11, and the water squeeze head 15 includes two penetrating slots 153 and four water squeeze rollers 151, and the water squeeze rollers 151 are arranged into two rows with two each rollers each, and a gap 152 is defined among the water squeeze rollers 151.

The pull handle 14 is pivotally coupled to the slide bushing 13 and can be turned up and down by using the pivotal connecting position of the slide bushing 13 as a fulcrum. In general, a protruding dot embedded into a corresponding slot (as shown in FIG. 3) for providing a fulcrum and achieving the aforementioned effect can be adopted.

In this embodiment, the lower end 112 of the mop tube 11 includes a fixing hole 115, and the water squeeze head 15 includes an opening 154 corresponding to the fixing hole 115, and a lock element 155 is passed through the opening 154 and the corresponding fixing hole 115 for securing the water squeeze head 15 to the lower end 112 of the mop tube 11. In this embodiment, the lock element 155 is a screw, but an insert pin or any other equivalent lock element with the same effect can be adopted.

In the figures, each link arm 16 includes an upper edge 161 and a lower edge 162, and the upper edge 161 is pivotally coupled to the pull handle 14 and can be turned with respect to the pull handle 14, and the lower edge 162 includes a hooking bracket 163. In this embodiment, each link arm 16 is passed through each through hole 153 of the water squeeze head 15, and the upper edge 161 of each link arm 16 is pivotally coupled to the pull handle 14 by a pivoting element 164. The pivoting element 164 is an insert pin, but a screw or any equivalent pivoting element with the same effect can be adopted.

The cleaning element 17 includes two hooking holes 171, a sponge 170 and a U-shaped fixing bar 172, wherein the sponge 170 is installed at the fixing bar 172, and the two hooking holes 171 are disposed at the fixing bar 172.

During the use of the mop structure, each hooking hole 171 of the cleaning element 17 is provided for hooking the hooking bracket 163 of each link arm 16. In other words, each link arm 16 is hooked into each hooking hole 171 of the cleaning element 17 by the hooking bracket 163 to install the cleaning element 17 to the link arm 16.

The cleaning element 17 is dipped into a detergent (not shown in the figure) for cleaning the floor, and then the pull handle 14 is pulled to turn the slide bushing 13 upward, so that the cleaning element 17 is driven by the pull handle 14 and each link arm 16 to move upward and pass through the gap 152 between the water squeeze rollers 151 of the water squeeze head 15 and squeezed by each water squeeze roller 151 to achieve the purpose of removing water from the cleaning element 17. On the other hand, the pull handle 14 is pulled to turn the slide bushing 13 downward, so that the pull handle 14 drives the link arm 16 to move downward and separate the cleaning element 17 from the water squeeze rollers 151.

From the description above, the cleaning element 17 and the link arm 16 are installed by hooking the hooking bracket 163 into the hooking hole 171, so that the cleaning element 17 can be mounted on to the link arms 16 very easily. In other words, the structural design of hooking the hooking bracket 163 into the hooking hole 171 provides an easy way of mounting and dismounting the cleaning element 17 without requiring an additional tool, and thus the invention provides a convenient application.

Referring to FIGS. 4 to 7, FIGS. 6 and 7 show another perspective view and another cross-sectional view of a mop structure in accordance with a first preferred embodiment of the present invention respectively. The adjusting sleeve 12 is turned, so that the principle of up and down movements of the adjusting sleeve thread 121 secured with the slide bushing thread 131 allows the slide bushing 13 to slide up and down with respect to the mop tube 11. In other words, the structural design of the adjusting sleeve thread 121 of the adjusting sleeve 12 secured with the slide bushing thread 131 of the slide bushing 13 can adjust the height of the slide bushing 13 with respect to the mop tube 11. In general, the cleaning element 17 becomes aged and loosened after being used for a while, and the relative distance between the cleaning element 17 and the water squeeze roller 151 can be adjusted (such that the water squeeze rollers 151 will be descended to a certain distance to compensate the stretched length of the cleaning element 17 due to ageing and loosening, and even the water squeeze roller 151 disposed at the lowest position is still attached normally to the cleaning element 17). This arrangement can avoid the poor water squeeze effect, shaking and breaking issues caused by the ageing and loosening of the cleaning element.

Figure 7:
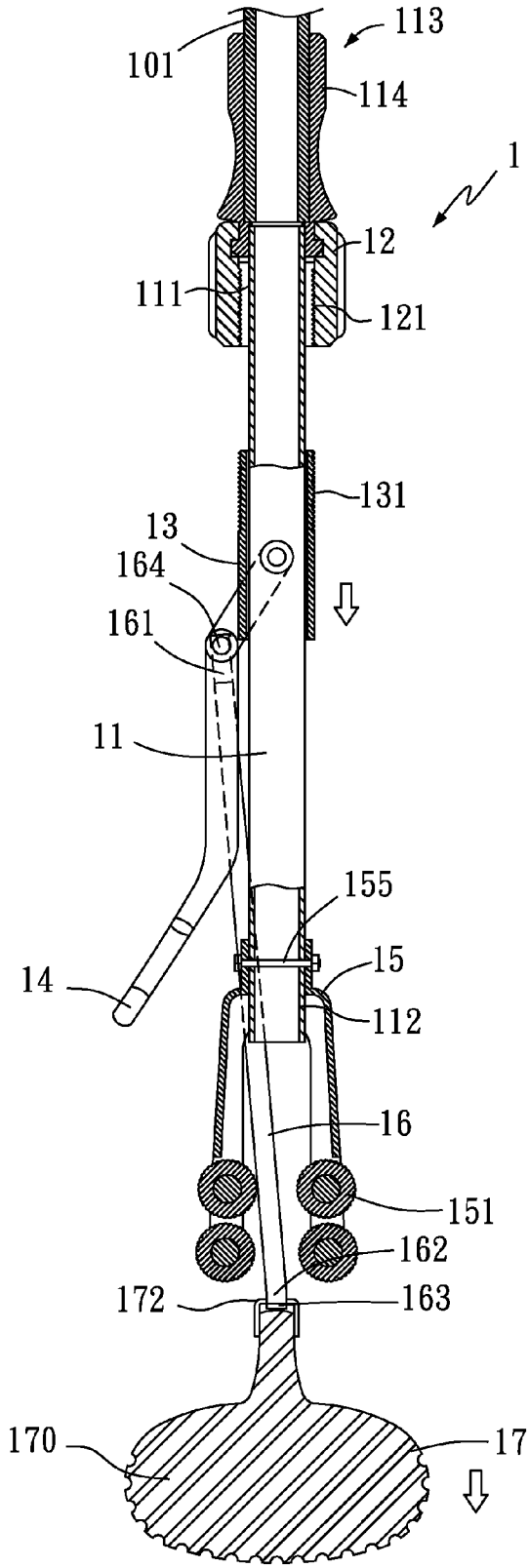
FIG. 7 is another cross-sectional view of a mop structure a mop structure in accordance with a first preferred embodiment of the present invention.

If the adjusting sleeve 12 is separated completely from the slide bushing 13 as shown in FIG. 7, the cleaning element 17 will be retracted from the water squeeze roller 151 in a certain distance to facilitate mounting and dismounting the cleaning element 17.

Figure 8:
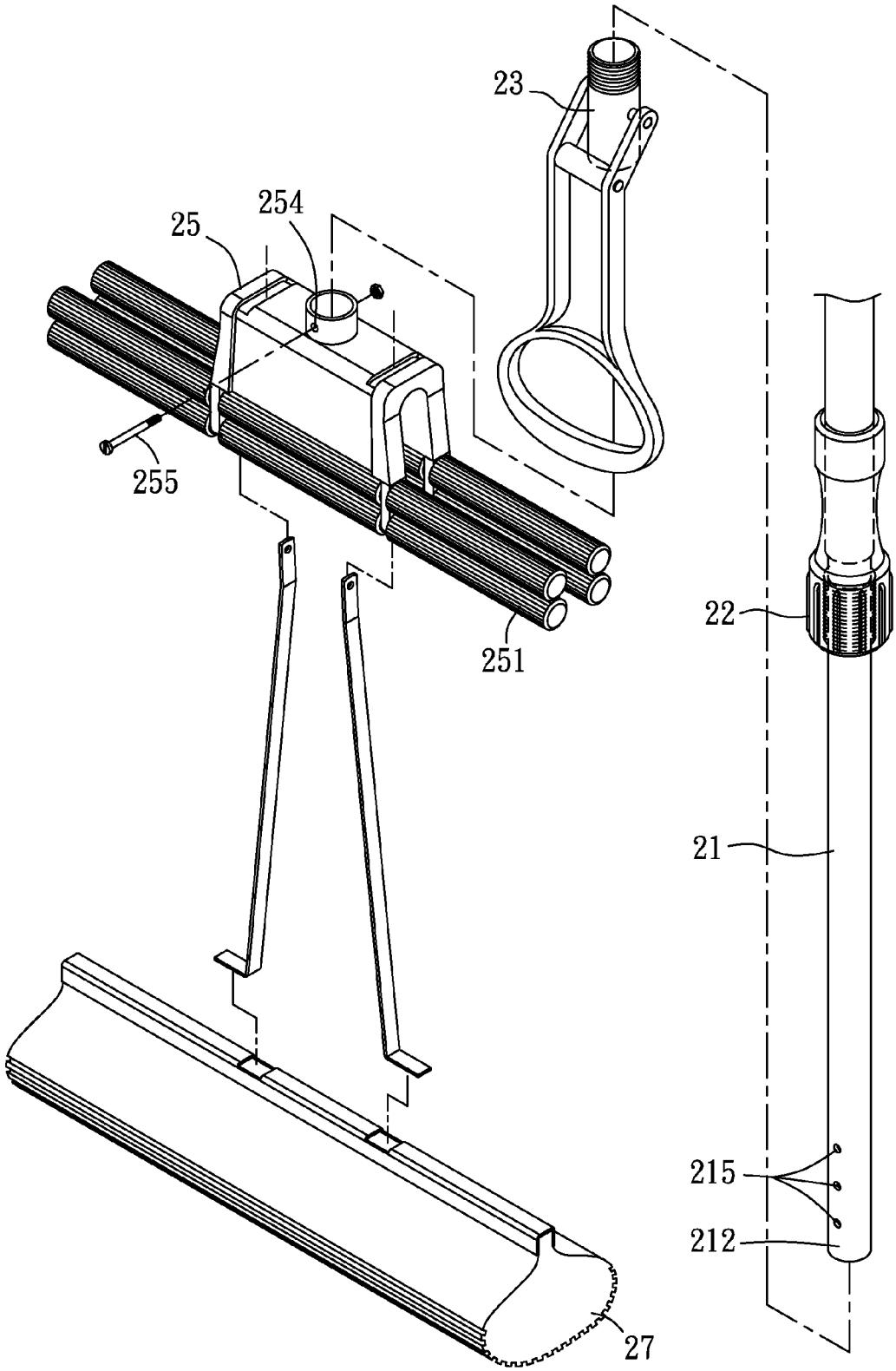
FIG. 8 is an exploded view of a mop structure in accordance with a second preferred embodiment of the present invention.

Referring to FIG. 8 for an exploded view of a mop structure in accordance with a second preferred embodiment of the present invention, the main structure of this embodiment is substantially the same as that of the first preferred embodiment, except there are a plurality of fixing holes 215 (such as three fixing holes 215 as shown in FIG. 8) disposed at the lower end 212 of the mop tube 21, and the opening 254 of the water squeeze head 25 corresponding to one of the fixing holes 215 is passed through the opening 254 and secured with one of the fixing holes 215 by a lock element 255 (which can be a screw, an insert pin or any equivalent lock element with the same effect) to secure the water squeeze head 25 to the lower end 212 of the mop tube 21.

The purpose of this structural design is to overcome the poor water squeeze effect, shaking and breaking issues of the cleaning element 27 due to ageing and loosening by turning the adjusting sleeve 22 to adjust the height of the slide bushing 23 with respect to the mop tube 21. If the adjusted distance is not sufficient, the structural design of the plurality of fixing holes 215 allows the water squeeze head 25 to use the fixing holes 215 to adjust the height of the water squeeze head 25 with respect to the mop tube 21. Besides turning the adjusting sleeve 22 to adjust the slide bushing 23, the invention also provides a structural design of the fixing holes 215 to strengthen the effect of adjusting the relative distance between the cleaning element 27 and the water squeeze rollers 251 in order to avoid the poor water squeeze effect, shaking and breaking issues of the cleaning element due to the ageing and loosening of the cleaning element 27.

In summation of the description above, the invention provides a convenient way of mounting and dismounting the cleaning element and improves the water squeeze effect and the convenience of use, and the invention complies with the requirements of patent application, and thus is duly filed for patent application.

While the invention has been described by means of specific embodiments, numerous modifications and variations could be made thereto by those skilled in the art without departing from the scope and spirit of the invention set forth in the claims.

1 mop structure
101 upper mop tube
11 mop tube
111 appropriate position
112 lower end
113 fixing portion
114 fixing sleeve
115 fixing hole
12 adjusting sleeve
121 adjusting sleeve thread
13 slide bushing
131 slide bushing thread
14 pull handle
15 water squeeze head
151 water squeeze roller
152 gap
153 penetrating slot
154 opening
155 lock element
16 link arm
161 upper edge
162 lower edge
163 hooking bracket
164 pivoting element
17 cleaning element
170 sponge
171 hooking hole
172 fixing bar
21 mop tube
212 lower end
215 fixing hole
22 adjusting sleeve
23 slide bushing
25 water squeeze head
251 water squeeze roller
254 opening
255 lock element
27 cleaning element
9 mop structure
91 mop tube
92 pull handle
93 water squeeze head
931 water squeeze roller
94 link arm
941 screw
95 sponge
951 loosened section

What is claimed is:

1. A mop structure, comprising:

a mop tube, having a fixing portion disposed at an appropriate position;

an adjusting sleeve, sheathed to the mop tube, coupled adjacently to the fixing portion, and turned with respect to the mop tube, and the adjusting sleeve including an adjusting sleeve thread;

a slide bushing, slidably installed at the mop tube, and including a slide bushing thread screwed correspondingly to the adjusting sleeve thread of the adjusting sleeve;

a pull handle, pivotally coupled to the slide bushing, and turned up and down with respect to the slide bushing;

a water squeeze head, installed at a lower end of the mop tube, and including at least two water squeeze rollers disposed at opposite sides of the water squeeze head to define a gap;

two link arms, each including an upper edge and a lower edge, and the upper edge being pivotally coupled to the pull handle and turned with respect to the pull handle, and the lower edge including a hooking bracket; and a cleaning element, including two hooking holes, each being hooked by the hooking bracket of each link arm, and the cleaning element being driven by the pull handle and each link arm to pass through the gap, and squeezed by each water squeeze roller.

2. The mop structure of claim 1, wherein the fixing portion of the mop tube includes a fixing sleeve, and the appropriate position refers to an upper end of the mop tube.

3. The mop structure of claim 2, further comprising an upper mop tube installed at the fixing sleeve of the fixing portion.

4. The mop structure of claim 1, wherein the adjusting sleeve thread of the adjusting sleeve is an internal thread, and the slide bushing thread of the slide bushing is an external thread.

5. The mop structure of claim 1, wherein the water squeeze head includes two penetrating slots, and each link arm is passed through each penetrating slot.

6. The mop structure of claim 1, wherein the lower end of the mop tube includes at least one fixing hole, and the water squeeze head includes an opening corresponding to the fixing hole, and a lock element passed through the opening and the fixing hole for locking and installing the water squeeze head at the lower end of the mop tube.

7. The mop structure of claim 1, wherein the upper edge of each link arm is pivotally coupled to the pull handle by a pivoting element.

8. The mop structure of claim 1, wherein the cleaning element includes a sponge and a fixing bar, and the sponge is installed at the fixing bar, and the two hooking holes are disposed at the fixing bar.

* * * * *